US005913291A

United States Patent [19]

Kobayashi et al.

[11] Patent Number: 5,913,291

[45] Date of Patent: Jun. 22, 1999

[54] TWO-CYCLE INTERNAL COMBUSTION ENGINE

[75] Inventors: Fujio Kobayashi; Katsuya Tajima, both of Tokyo, Japan

[73] Assignee: Kioritz Corporation, Tokyo, Japan

[21] Appl. No.: 08/987,075

[22] Filed: Dec. 9, 1997

[30] Foreign Application Priority Data

Dec. 9, 1996 [JP] Japan ..... 8-328230

[51] Int. Cl.[6] ..... F02M 29/00; B27B 17/00

[52] U.S. Cl. ..... 123/73 A

[58] Field of Search ..... 123/73 A, 73 PP, 123/65 P

[56] References Cited

U.S. PATENT DOCUMENTS 4,682,571 7/1987 Kaufman et al. ..... 123/73 A 4,770,131 9/1988 Tuckey ..... 123/73 A 5,699,761 12/1997 Yamaguchi et al. ..... 123/73 A

*Primary Examiner*—Marguerite McMahon

*Attorney, Agent, or Firm*—Baker & Botts, L.L.P.

[57] ABSTRACT

A two-cycle internal combustion engine including a carburetor, a crankcase provided with a crank chamber and a suction port, an insulator attached to the crankcase and provided with a suction passage for introducing the air-fuel mixture from the carburetor to the suction port, and a reed valve whose proximal end portion is fixed to the insulator so as to allow a free end portion thereof to be optionally press-contacted with the downstream side end face of the insulator, wherein the downstream side end face of the insulator is slanted by a predetermined angle, while the suction port is contiguously connected with the slanted downstream side end face of the insulator without substantially forming a stepped portion therebetween.

2 Claims, 3 Drawing Sheets

TWO-CYCLE INTERNAL COMBUSTION ENGINE

BACKGROUND OF THE INVENTION

1. Field of the Invention

The present invention relates to a two-cycle internal combustion engine, suited for use in a portable working machine, such as a chain saw, which is adapted to be operated in various postures.

2. The Prior Art

As a power source for a portable working machine, such as a chain saw, which is adapted to be operated in various postures, an air-cooled two-cycle gasoline internal combustion engine of small type (hereinafter referred to as a two-cycle internal combustion engine or simply as an engine) is usually employed. Since the size of such a two-cycle internal combustion engine is generally larger in the longitudinal direction (height) than in the lateral direction, the engine is generally arranged horizontally in a main case, as seen in the case of a small chain saw for instance.

In the case of the aforementioned two-cycle internal combustion engine which is adapted to be laid horizontally in the main case of a working machine, such as a chain saw, and particularly in the case of the engine as shown in Japanese Utility Model Unexamined Publication S/56-140402 (corresponds to U.S. Pat. No. 4,370,809), wherein a suction port is formed at the bottom (a forward portion when viewed in a laid posture) of a crankcase and an air-fuel mixture from a carburetor is sucked from a suction port via a lead valve to the crankcase to be pre-compressed therein, the resultant pre-compressed air-fuel mixture being transferred through a scavenging passage to a combustion chamber, there has been frequently experienced a phenomenon of extraordinary fluctuation of rotational speed or sudden stalling of the engine, resulting in the stoppage of the engine when the forward portion of the working machine (chain saw) is directed upward or obliquely upward after the working machine is operated while directing the forward portion thereof downward or obliquely downward for a period of time.

The cause for this phenomenon has been studied by the present inventors and made clear as follows. Namely, an unatomized raw fuel (a liquid fuel) which has adhered at first on the inner peripheral wall of a crank chamber of the engine collectively flows into the suction port to be accumulated therein throughout a period when the forward portion of the working machine is directed downward or obliquely downward, i.e. when the suction port which opens to the crankcase of the engine is directed downward or obliquely downward. However, when the forward portion of the working machine is directed upward or obliquely upward, this unatomized fuel that has been accumulated in the suction port is caused to flow into the scavenging passage through the inner peripheral wall of the crank chamber and then rush-flows into the combustion chamber from the scavenging passage, thereby supplying an excessively thickened air-fuel mixture to the combustion chamber for combustion. In other words, the cause for the phenomenon can be ascribed to an undesirable flow of unatomized raw fuel due to the change in posture of the engine. To date, however, no practically effective means has been provided to eliminate this undesirable phenomenon.

When the engine is in a state of high load and high rotational speed, the quantity of fuel per unit time is relatively large, so that even if the unatomized raw fuel is allowed to rush-flow into the combustion chamber as mentioned above, no serious inconvenience would be caused to occur though some degree of fluctuation in rotational speed may be caused to occur. However, when the engine is in a state of idling, the quantity of fuel per unit time is relatively little so that when the unatomized raw fuel is allowed to rush-flow into the combustion chamber, the air-fuel mixture becomes excessive in thickeness, thus giving rise to a serious problem, e.g. the stoppage of the engine.

In an attempt to solve this problem, the present inventors have proposed (See Japanese Patent Unexamined Publication H/9-151739) the installation of a flow control portion such as a linear projection, groove or recess at a portion of the inner peripheral wall of the crank chamber which is in the vicinity of the suction port for reducing the flow rate of the unatomized raw fuel.

One example of a two-cycle internal combustion engine provided with this flow control portion is illustrated in FIG. 4, which shows a cross-section of the main portion of the two-cycle internal combustion engine. This two-cycle internal combustion engine 100 comprises a carburetor 30 constituting means for forming an air-fuel mixture, a crankcase 20 provided with a crank chamber 22 and a suction port 25 opening to the crank chamber 22, an insulator 40 attached to the crankcase 20 and provided with a suction passage 42 for introducing the air-fuel mixture from the carburetor 30 to the suction port 25, and a reed valve 35 formed of a tab-shaped elastic piece whose proximal end portion 35*a* is fixed to the downstream side end face 40A of the insulator 40 facing the suction port 25 so as to allow a free end portion 35*b* of the tab-shaped elastic piece to be optionally press-contacted with the downstream side end face 40A of the insulator 40, thereby opening or closing the suction passage 42.

A pair of linear projections 23 (each functioning as a flow-controlling member for controlling flow speed of unatomized raw fuel), each being rectangular in cross-section and spaced apart from the other, are formed on the inner peripheral wall 22A of the crank chamber 22, traversing the whole width of the crank chamber 22, in close proximity to the suction port 25 and in parallel with a crank shaft rotatably supported in the crankcase 20.

According to the engine 100 constructed in this manner, even if the unatomized raw fuel which has been trapped at the suction port 25 tends to flow into the scavenging passage (the outside of the apparatus shown in FIG. 4) through the inner peripheral surface 22A of the crank chamber 22, the flow of the unatomized raw fuel is interrupted by the pair of linear projections 23 (each functioning as a flow-controlling member) formed on the inner peripheral wall 22A of the crank chamber 22 in close proximity to the suction port 25, thus resulting in a prominent slow down in the flow rate of the unatomized raw fuel.

Therefore, the possibility that the unatomized raw fuel would flow into the combustion chamber in a rush-flow manner through the inner peripheral wall of the crank chamber can be remarkably reduced. As a result, the possibility of a violent fluctuation of rotational speed of the engine or a sudden stalling or stoppage of the engine can be remarkably reduced.

However, even in this engine 100 provided as mentioned above with a flow controlling member, i.e. the linear projections 23 formed on the inner peripheral surface 22A of the crank chamber 22, a phenomenon of rush-flow of unatomized raw fuel into the combustion chamber has been occasionally recognized when the suction port 25 is suddenly directed upward or obliquely upward after the suction port 25 has been directed downward or obliquely downward for a long period of time. Namely, a large quantity of the unatomized raw fuel tends to be trapped at the stepped corner portion P which is located at the downstream side end face 40A of the insulator 40 below the free end portion 35*b* of the reed valve 35, and the resultant trapped unatomized raw fuel is sometimes caused to rush-flow, passing over the linear projections 23, into the combustion chamber. In other words, the provision of the aforementioned flow-controlling member is not sufficient to completely control the flow of the unatomized raw fuel, i.e. the aforementioned problem is not yet completely solved.

BRIEF SUMMARY OF THE INVENTION

The present invention has been made under the circumstances mentioned above, and therefore an object of the present invention is to provide a two-cycle internal combustion engine which is capable of inhibiting the flow of unatomized raw fuel after the unatomized raw fuel is trapped at the suction port of the crankcase and, at the same time, is capable of inhibiting the unatomized raw fuel from being trapped at the suction port of the crankcase, even if the posture of the engine is changed due to a change in posture of the working machine, thereby completely preventing the undesirable phenomenon of the stoppage of the engine due to a rush-flow of the unatomized raw fuel into the combustion chamber.

Namely, according to the present invention, there is provided a two-cycle internal combustion engine comprising an air-fuel mixture-generating means such as a carburetor, a crankcase provided with a crank chamber and a suction port which opens to the crank chamber, an insulator attached to and contacting the crankcase and provided with a suction passage for introducing the air-fuel mixture from the air-fuel mixture-generating means to the suction port, and a reed valve formed of a tab-shaped elastic piece whose proximal end portion is fixed to the downstream side end face of the insulator facing the suction port, so as to allow a free end portion of the tab-shaped elastic piece to be optionally press-contacted with the downstream side end face of the insulator and thereby open or close the suction passage.

This two-cycle internal combustion engine is characterized in that a portion of the downstream side end face of the insulator where the free end portion of the reed valve is disposed is slanted by a predetermined angle, thus protruding toward the suction port, while a portion of the suction port which is located near the free end portion of the reed valve is contiguously connected with the slanted downstream side end face of the insulator without substantially forming a stepped portion therebetween.

According to a preferable embodiment of the present invention, an angle formed between the slanted downstream side end face of the insulator and the portion of the suction port contiguously connected with the slanted downstream side end face of the insulator is 120 degrees or more.

Since the portion of the downstream side end face of the insulator is slanted and contiguously connected with the passage portion of the suction port without substantially forming a stepped portion therebetween in the two-cycle internal combustion engine constructed as described above, according to the present invention, it is possible to effectively prevent the accumulation of the unatomized raw fuel at the suction port and to make smooth the flow of the air-fuel mixture which is being sucked into the suction port through the reed valve as compared with the conventional engine where a stepped portion is formed between the downstream side end face of the insulator and the suction port, even if the posture of the engine is suddenly altered and, more specifically, even if the suction port is suddenly directed upward or obliquely upward after the suction port has been kept directed downward or obliquely downward for a long period of time. In other words, since the flow speed of the air-fuel mixture passing through the suction port is accelerated, the atomization of the fuel would be promoted and, at the same time, the unatomized raw fuel accumulated, if any, at the suction port would be easily dispersed toward the crank chamber, thus making it difficult for the liquid unatomized raw fuel to flow into the inner peripheral wall of the crank chamber.

As a result, even if the posture of the engine is changed due to a change in posture of the working machine, the unatomized raw fuel which tends to accumulate at the suction port can be prevented from flowing into the inner peripheral wall of the crank chamber, and at the same time, the accumulation of the unatomized raw fuel at the suction port of the crankcase can be sucked. Accordingly, it is possible to prevent an extraordinary change in the rotational speed of the engine, or accidents such as the stalling or stoppage of the engine due to a rush-flow of the unatomized raw fuel into the combustion chamber.

Moreover, since the two-cycle internal combustion engine according to the present invention can be manufactured by simply modifying the shapes of the downstream side end face of the conventional insulator and of the suction port of the crankcase, an increase in manufacturing cost by this modification would be negligible.

DETAILED DESCRIPTION OF THE INVENTION

The present invention will be further explained with reference to the drawings, which depict one embodiment of a two-cycle internal combustion engine according to the invention.

Figure 1:
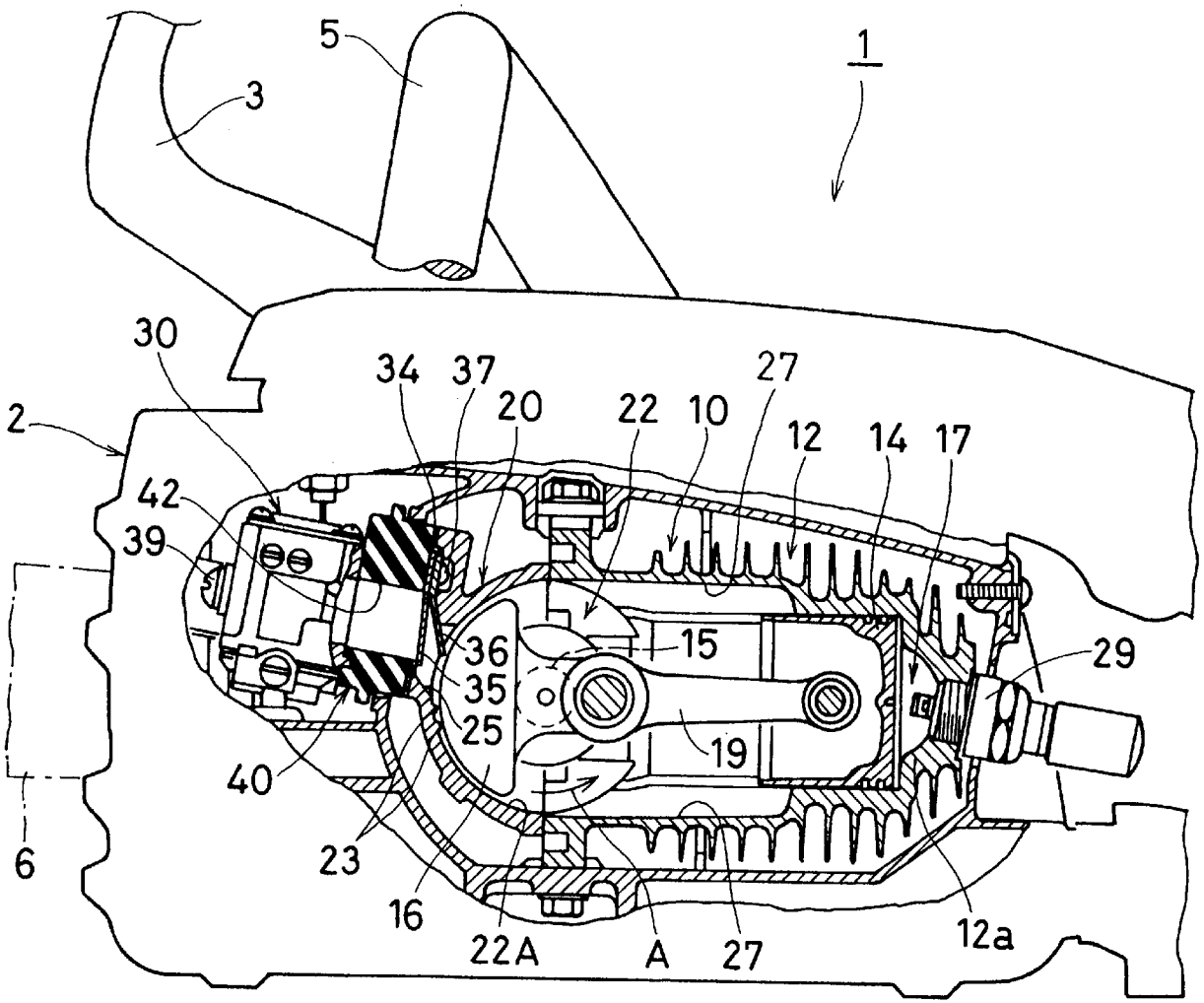
FIG. 1 is a longitudinal sectional view illustrating one embodiment of a two-cycle internal combustion engine according to the present invention.

FIG. 1 shows a chain saw 1 which is provided with a two-cycle internal combustion engine 10 according to the present invention.

The chain saw 1 illustrated herein comprises a main case 2, a working member 6 such as a saw chain which is detachably mounted on the forward portion of the main case 2, a brake handle 3 functioning also as a hand guard which is attached to the upper portion of the main case 2, and a main handle 5 which is also attached to the upper portion of the main case 2.

An air-cooled two-cycle gasoline engine 10 of small type according to this embodiment is housed in the main case 2 in such a manner that the engine 10 is substantially horizontally laid down with the cylinder head 12*a* thereof being directed rearwardly, i.e. a cylinder block 12 is disposed on the rear side, while a semi-circular crankcase 20 connected with the cylinder block 12 is disposed on the forward side, of the main case 2.

A piston 14 is inserted in the cylinder block 12, and a combustion chamber 17 is partitioned by the top face of the piston 14. An ignition plug 29 is attached to the top portion of the cylinder head 12*a*, the tip end portion of the plug 29 protruding into the combustion chamber 17.

The reciprocating movement of the piston 14 is converted via a connecting rod 19 into a rotational movement of a crank shaft 15 which is axially supported by a bearing (not shown) disposed between the crankcase 20 and the lower portion of the cylinder block 12. When the crank shaft 15 is rotated in this manner, the balance weight 16 which is attached to the crank shaft 15 is concurrently caused to rotate within the crank chamber 22 defined between the crankcase 20 and the lower portion of the cylinder block 12 and in the direction indicated by the arrow A in FIG. 1.

A suction port 25 is formed at a portion of the crankcase 20 which is located on the upper side of the bottom of the crank chamber 22 (or the forward portion as viewed in the laid down state of the engine 10).

An air-fuel mixture supplied from a diaphragm type carburetor 30 functioning as an air-fuel mixture-generating means is transferred into a suction passage 42 formed in an insulator 40 whose contacting face 40B (see FIG. 2) is attached with a sealing member 34 to the crankcase 20, and then introduced through a reed valve 35 which is made of a tab-like elastic piece into the suction port 25. Then, the air-fuel mixture thus introduced into the suction port 25 is sucked and pre-compressed in the crank chamber 22 to be subsequently introduced, via the scavenging passages 27 communicating with the crank chamber 22, into the combustion chamber 17.

Figure 2:
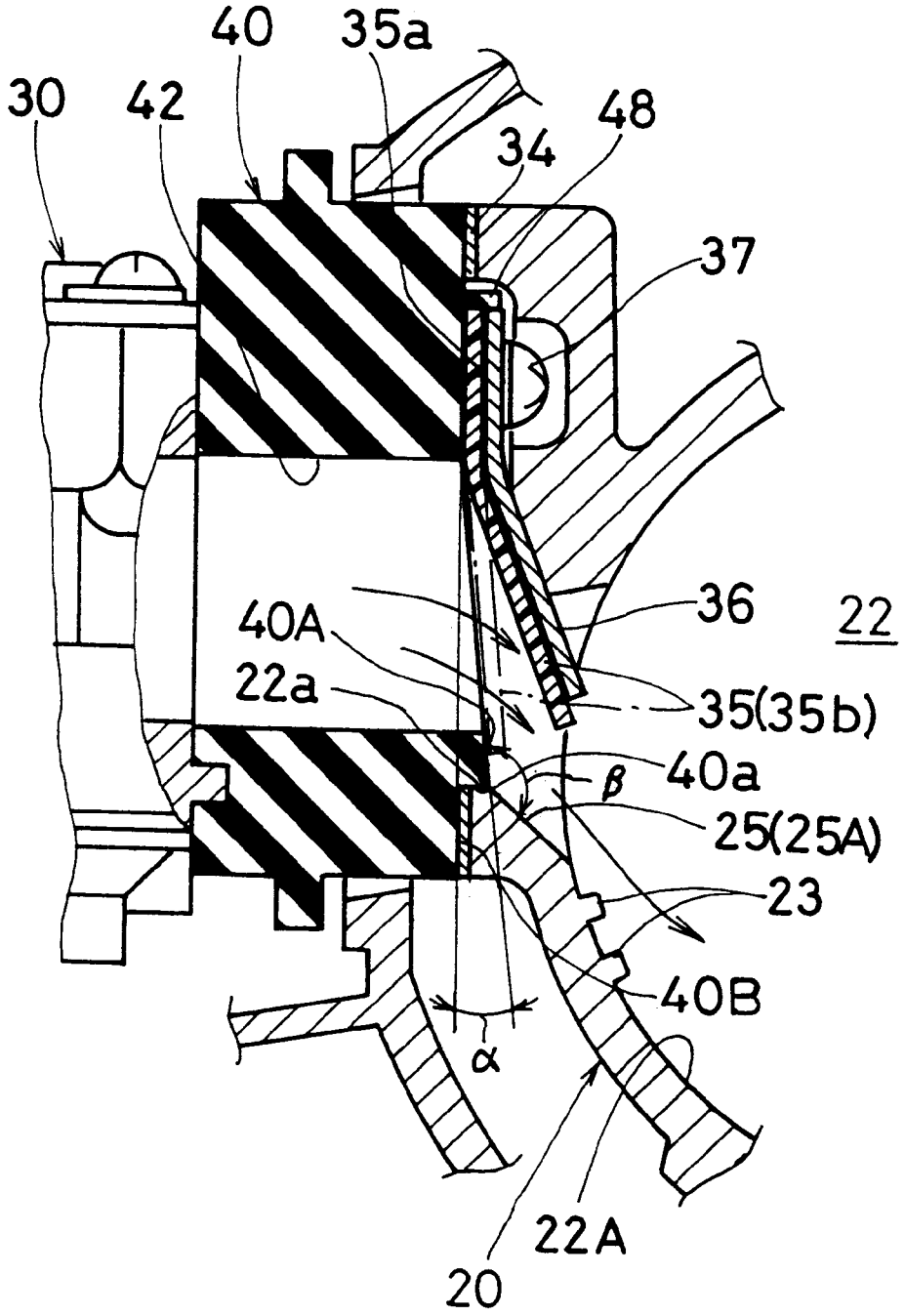
FIG. 2 is a partially sectioned enlarged side view of a chain saw illustrating the suction port portion of the two-cycle internal combustion engine shown in FIG. 1.
Figure 3:
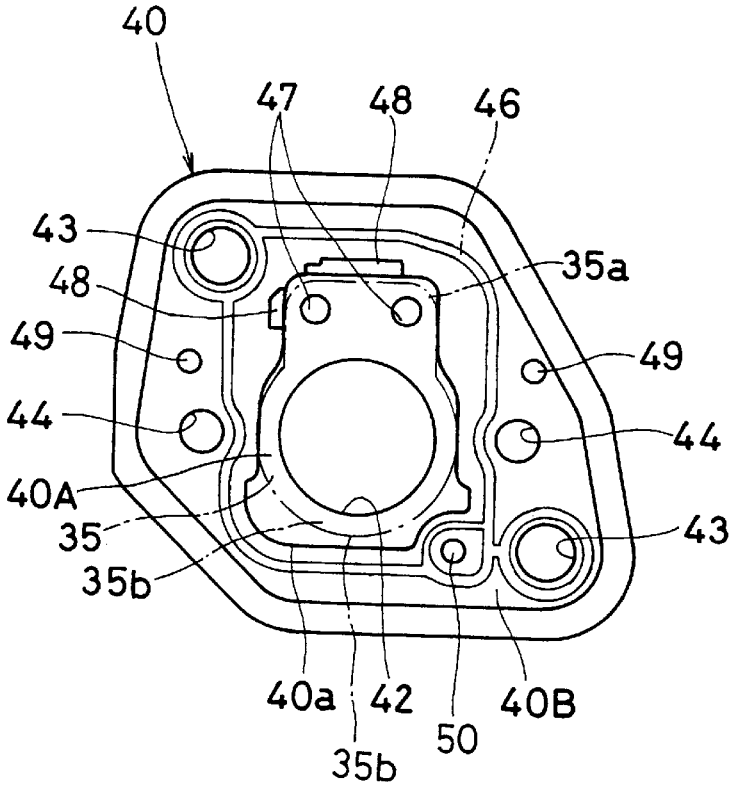
FIG. 3 is a plan view showing the downstream side end face of an insulator employed in the two-cycle internal combustion engine shown in FIG. 1.

As clearly seen from FIGS. 2 and 3, the reed valve 35 in this embodiment is secured together with a slightly bent lead stopper 36 to the downstream side end face (attachment surface) 40A of the insulator 40, which faces towards the suction port 25. More specifically, the proximal end portion 35*a* of the reed valve 35 is fastened together with the proximal end portion of the reed stopper 36 to the downstream side end face 40A of the insulator 40 by means of screws 37. Thus, the reed valve 35 may be optionally press-contacted with the downstream side end face 40A, thereby allowing the suction passage 42 to be opened or closed by the reed valve 35.

The insulator 40 (see FIG. 3) is provided with bolt-holes or tapped holes 43 and 44 for inserting attachment bolts and tapped holes 47 for inserting reed valve-fastening screws 37, these holes being extended along the axial direction of the insulator 40.

The insulator 40 is further provided at the contacting face 40B which is to be contacted with the crankcase 22 with a circular rib 46 for hermetically sealing it with the crankcase 22. As shown in FIG. 3, the insulator 40 is further provided with columnar protrusions 49 for aligning it with the crankcase 22, with elongated protrusions 48 for positioning the reed valve 35 and with a pulsating pressure-drawing hole 50 communicating with the carburetor 30.

Additionally, as shown in FIG. 2, a portion of the downstream side end face 40A of the insulator 40 where the free end portion 35*b* of the reed valve 35 is disposed is slanted by an angle of $\alpha$, thus protruding from the contacting face 40B towards the suction port 25, while a surface portion 25A of the suction port 25 which is located near the free end portion 35*b* of the reed valve 35 is contiguously connected with the slanted downstream side end face 40A of the insulator 40 without substantially forming a stepped portion therebetween. In this case, the lowermost surface 40*a* of the slanted downstream side end face 40A is closely contacted with the extended surface 22A of the suction port 25 of the crankcase 20, and the angle $\beta$ formed between the slanted downstream side end face 40A of the insulator 40 and the surface portion 25A of the suction port 25 is about 120 degrees.

Figure 4:
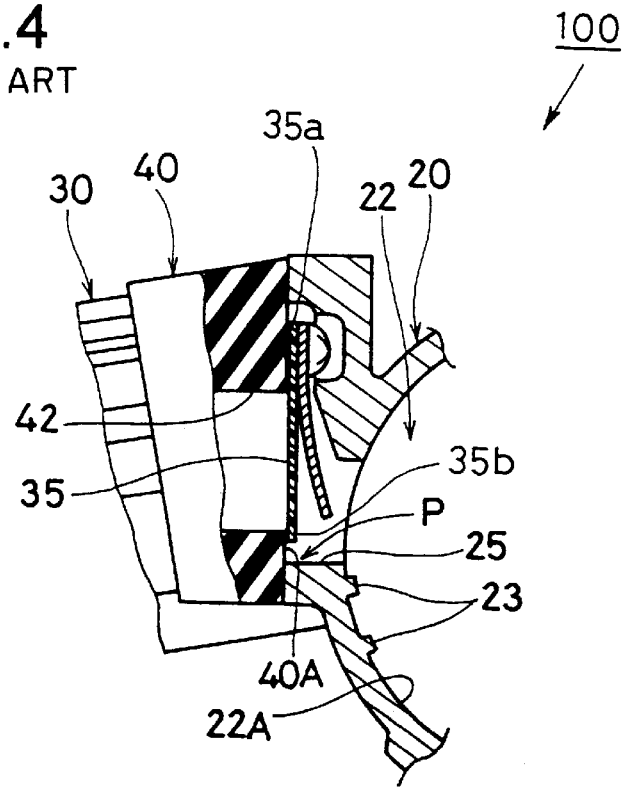
FIG.4 PRIOR ART
FIG. 4 is a partially sectioned enlarged side view of the suction port portion of a two-cycle internal combustion engine according to the prior art.

In the same manner as shown in FIG. 4, a pair of linear projections 23, each being rectangular in cross-section and spaced apart from the other, are formed on a portion of the inner peripheral wall 22A of the crank chamber 22 in close proximity to the suction port 25, traversing the whole width of the crank chamber 22 and in parallel with the crank shaft 15. As described above in connection with FIG. 4, the linear projections 23 function as flow-controlling members for reducing the flow speed of the unatomized raw fuel.

Since the portion of the downstream side end face 40A of the insulator 40 is slanted and contiguously connected with the surface portion 25A of the suction port 25 without substantially forming a stepped portion therebetween in the two-cycle internal combustion engine 10 constructed as described above according to the present invention, it is possible to effectively prevent the accumulation of the unatomized raw fuel at the suction port 25 and to make smooth the flow of the air-fuel mixture which is being sucked into the suction port 25 through the reed valve 35, as compared with the conventional engine where a stepped portion is formed between the downstream side end face 40A of the insulator 40 and the surface portion 25A of suction port 25. This advantage is afforded even if the posture of the engine 10 is suddenly altered, more specifically, even if the suction port 25 is suddenly directed upward or obliquely upward after the suction port 25 is kept directed downward or obliquely downward for a long period of time. In other words, since the flow speed of the air-fuel mixture passing through the suction port 25 is accelerated, the atomization of the fuel would be promoted and, at the same time, the unatomized raw fuel accumulated, if any, at the suction port 25 would be easily dispersed toward the crank chamber 22, thus making it difficult for the liquid unatomized raw fuel to flow along the inner peripheral wall 22A of the crank chamber 22.

Additionally, even if the unatomized raw fuel which has happened to be trapped at the suction port 25 tends to flow into the lower scavenging passage 27 through the inner peripheral surface 22A of the crank chamber 22, the flow of the unatomized raw fuel is interrupted by the pair of linear projections 23 (each functioning as a flow-controlling member) formed on the inner peripheral wall 22A of the crank chamber 22 in close proximity to the suction port 25, thus resulting in a much reduced flow speed of the unatomized raw fuel.

Therefore, it is possible to minimize the possibility that any unatomized raw fuel that has happened to be accumulated at the suction port 25 would flow along the inner peripheral wall 22A of the crank chamber 22 even if the posture of the engine 10 is suddenly changed, due to a change in posture of the chain saw 1 for instance, and the possibility that the unatomized raw fuel would be collectively accumulated at the suction port 25. As a result, the accident of a violent fluctuation of rotational speed of the engine 10 or a sudden stalling or stoppage of the engine 10 due to a rush-flow of unatomized raw fuel into the combustion chamber 17 can be effectively prevented.

Moreover, since the two-cycle internal combustion engine 10 according to the present invention can be manufactured by simply modifying the shapes of the downstream side end face 40A of the conventional insulator 40 and of the suction port 25 of the crankcase 20, any increase in manufacturing cost resulting from this modification would be negligible.

In the foregoing explanation, the present invention has been explained with reference to one embodiment. However, the present invention should not be construed to be limited to this embodiment, but may be variously modified within the spirit and scope of the appended claims.

For example, in the embodiment described above, the angel β formed between the slanted downstream side end face 40A of the insulator 40 and the surface portion 25A of the suction port 25 is selected to be about 120 degrees. The larger the angle β is, however, the smoother the flow of the air-fuel mixture becomes and the less likely it is that unatomized gas will accumulate. Hence, the angle β should be set as large as possible.

As would be clearly understood from the foregoing explanations, since a portion of the downstream side end face of the insulator is slanted and contiguously connected with the surface portion of the suction port without substantially forming a stepped portion therebetween in the two-cycle internal combustion engine according to the present invention, it is possible to effectively prevent the accumulation of unatomized raw fuel at the suction port and to make smooth the flow of air-fuel mixture which is being sucked into the suction port through the reed valve, thereby minimizing the possibility of a collective liquefying of fuel, as compared with the conventional engine where a stepped portion is formed between the downstream side end face of the insulator and the surface portion of suction port, even if the posture of the engine is suddenly altered. As a result, the possibility of unatomized raw fuel accumulating at the suction port of the crankcase and flowing along the inner peripheral wall of the crankcase can be minimized. As a result, the accident of a violent fluctuation of rotational speed of the engine or a sudden stalling or stoppage of the engine due to a rush-flow of unatomized raw fuel into the combustion chamber can be effectively prevented.

We claim:

1. In a two-cycle internal combustion engine comprising an air-fuel mixture-generating means, a crankcase provided with a crank chamber and a suction port which opens to the crank chamber, an insulator attached to and contacted with the crankcase and provided with a suction passage for introducing the air-fuel mixture from the air-fuel mixture-generating means to the suction port, and a reed valve formed of a tab-shaped elastic piece whose proximal end portion is fixed to the downstream side end face of the insulator facing the suction port so as to allow a free end portion of the tab-shaped elastic piece to be optionally press-contacted with the downstream side end face of the insulator, thereby opening or closing the suction passage, the improvement comprising:

a portion of the downstream side end face of the insulator where the free end portion of the reed valve is disposed is slanted by a predetermined first angle, thus protruding toward the suction port, while a portion of the suction port which is located near the free end portion of the reed valve is contiguously connected with the slanted downstream side end face of the insulator without substantially forming a stepped portion therebetween.

2. The two-cycle internal combustion engine according to claim 1, wherein a predetermined second angle formed between said slanted downstream side end face of the insulator and said portion of the suction port contiguously connected with the slanted downstream side end face of the insulator is 120 degrees or more.

* * * * *